United States Patent [19]

Sero

[11] 3,962,837

[45] June 15, 1976

[54] APPARATUS FOR EXPANDABLY ENGAGING THE WALLS OF AN EARTHEN HOLE

[76] Inventor: Samuel J. Sero, 5614 Walnut St., Pittsburgh, Pa. 15232

[22] Filed: Oct. 11, 1974

[21] Appl. No.: 514,091

[52] U.S. Cl. ..... 52/158; 52/159; 61/45 B; 85/65; 166/63

[51] Int. Cl.[2] ..... F02D 5/74

[58] Field of Search ..... 52/155, 158, 159, 160, 52/156; 61/53.72, 39, 45 B; 85/65; 166/63, 217

[56] References Cited

UNITED STATES PATENTS

| | | | |
|---|---|---|---|
| 787,017 | 4/1905 | Witmer | 52/160 |
| 1,173,806 | 2/1916 | Johson | 61/53.72 |
| 1,330,233 | 2/1920 | Blackburn | 52/159 |
| 1,807,488 | 5/1931 | Michalicek | 52/159 |
| 1,964,610 | 6/1934 | Wagner | 52/159 |
| 3,118,284 | 1/1964 | Cobi | 61/53.72 |
| 3,131,544 | 5/1964 | Thornley | 61/53.72 |
| 3,214,918 | 11/1965 | Binnings | 61/53.72 |
| 3,525,187 | 8/1970 | Vincent | 52/155 |

*Primary Examiner*—Ernest R. Purser
*Assistant Examiner*—William Randolph
*Attorney, Agent, or Firm*—Buell, Blenko, & Ziesenheim

[57] ABSTRACT

An apparatus is provided for expandably engaging the walls of an earthen hole in order to resist movement urged by an external force. After placement of the apparatus into an earthen hole at a location where some external force is to be restrained, the detonation of an explosive charge drives a piston out of an explosion chamber, and by a wedging action, forces an axially segmented cylinder outwardly against the surrounding earth. A substantially stable connecting foundation is thus created in order to resist either tensile or compressive forces.

11 Claims, 5 Drawing Figures

Fig. 3.
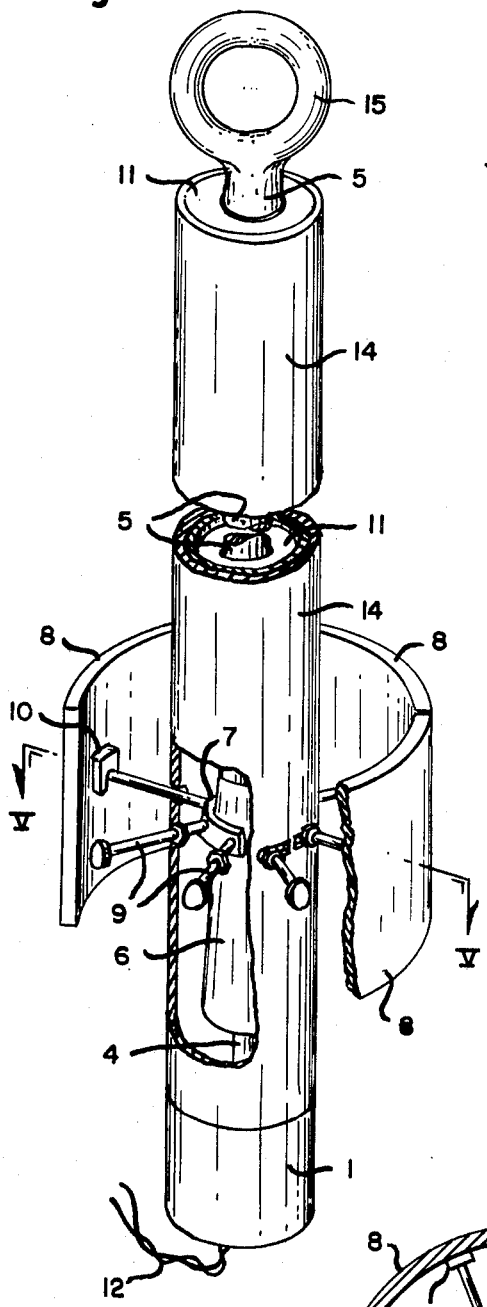
Fig. 4.
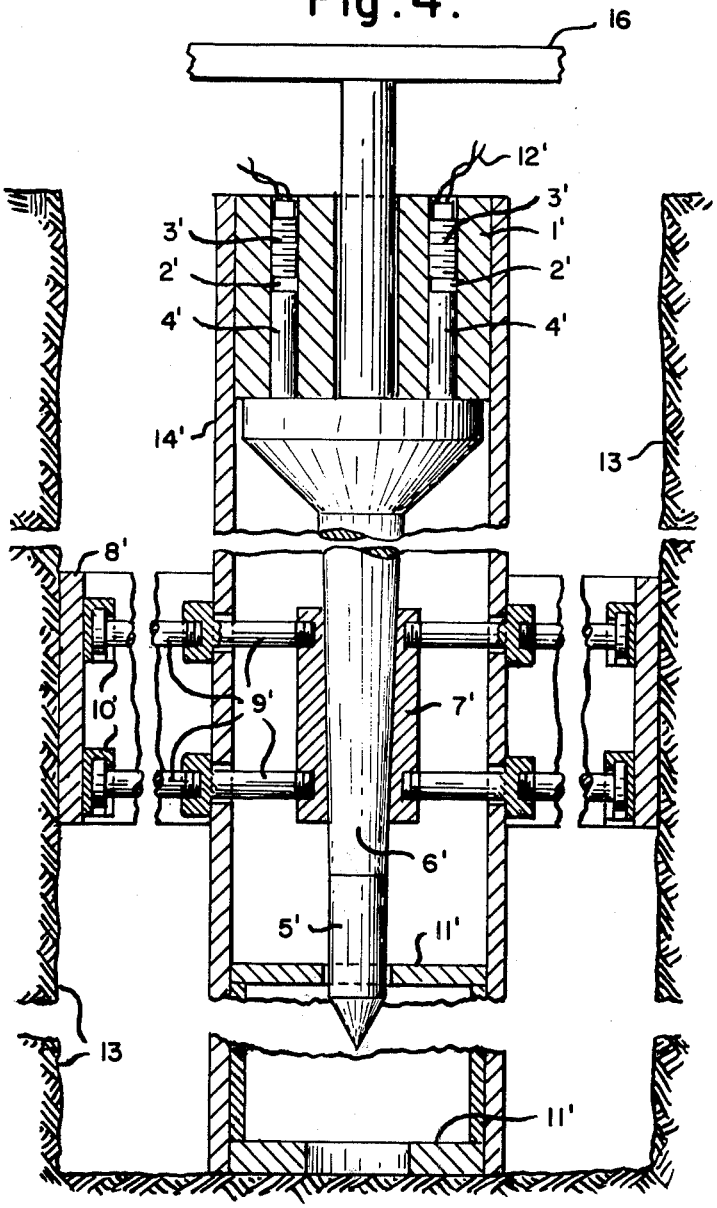
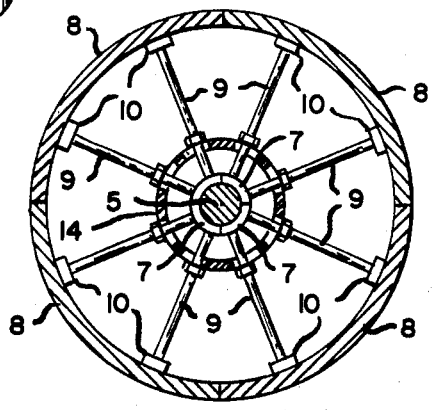
Fig. 5.

APPARATUS FOR EXPANDABLY ENGAGING THE WALLS OF AN EARTHEN HOLE

This invention relates to an earth engaging apparatus and particularly to an apparatus for expandably engaging the walls of an earthen hole in order to resist movement urged by an external force such as the tensile force exerted by a guy line supporting a transmission tower or the compressive force exerted by almost any structure requiring a foundation, e.g., a transmission tower, a highway lighting standard, a trailer home, etc.

Earth anchors are old and well known in the art of restraining tensile forces. Some examples of various earth anchors are described in the following patents: Ballew — U.S. Pat. No. 3,763,610; Scholl — U.S. Pat. No. 3,432,977; Luedloff et al. — U.S. Pat. No. 3,222,842; Des Champs — U.S. Pat. No. 3,187,858; and Thomas — U.S. Pat. No. 899,274. Of these earlier patents, only Ballew has any pertinence whatever, but its structure is totally different and it is operatively insufficient to perform all the functions of my invention. An earth anchor such as is disclosed by the Ballew patent does not provide the exceptional flexibility of use and economies provided by my invention. The Ballew apparatus, which employs a jacking device to force engagement with the earthen wall, cannot be adapted to be driven by an explosive charge. The impact force and continuing chamber pressure resulting from detonation of the explosive charge in my invention serve to hold the bearing plates in place during backfilling and engagement with the external force. The Ballew apparatus, on the other hand, is incapable of reliably maintaining its expanded position absent engagement with the external force, and cannot, in fact, be used to restrain movement urged by an external compressive force. Furthermore, the Ballew apparatus is not easily adjustable to various hole diameters and the bearing surface is not independent of its sliding wedge member.

Plate Anchors and Mechanically Expanding Anchors have been used for years, but require a great deal of time and expense to install and are not reliable as permanent anchors in a wide range of soil types. Power Installed Screw Anchors are the type most often used today, but here too, additional power equipment as well as substantial labor, equipment, and training time are required to implant the anchor. For example, an average of about thirty anchors are lost when training inexperienced employees to use the screw anchor equipment. The screw type anchor serves best when it is implanted at the same angle as the guy line it secures, and the equipment and time necessary to accomplish this require additional and substantial expense. A screw anchor is also subject to breakage when subsurface rocks are unexpectedly encountered during installation. Finally, the screw anchor, because it is difficult to install at exactly the guy line angle, is subject to loosening over a period of time due to forces perpendicular to it caused, for example, by the swaying of a transmission tower in the wind.

Foundations have been and still are almost universally formed substantially by casting concrete into a prepared earthen hole. This type of foundation, though reliable, is expensive to form, is time consuming to install, is costly to remove when no longer required, and is uneconomical to reuse.

The present invention provides a novel apparatus for engaging the walls of an earthen hole. It provides an apparatus which is capable of being pre-assembled substantially with presently available materials, which is easily and quickly installed, which is removable for reuse if required (e.g., for a temporary, economical guy line anchor), and which requires only a vertical hole for installation. This is significant in that vertical holes are substantially easier and more economical to bore, and permit efficient use of equipment generally presently available. Ease of removal and reuse are important economical features of this apparatus since, presently, long term right-of-ways must be purchased for anchors and foundations which will be used only temporarily (as for emergency guard posts, light standards, etc.). The present invention, on the other hand, will permit substantial savings by eliminating the need for purchasing long term right-of-ways when only temporary fixtures are required. The piston charges are especially accessible for ease of removal when the apparatus is used as a foundation and this allows even greater flexibility for reuse.

The present invention is self tightening when in service thus insuring a more reliable earth connection. Variable or increased loads only serve to increase the strength of its earth wall contact. Furthermore, it is the only apparatus which can be used effectively to engage extremely rocky earth, the keys to this application being the ease of installation and the horizontal self-tightening earth engagement feature. Very soft or weak soil conditions require only an increase in the bearing surface area (vertical height) of the cylindrical segment bearing plates in order to prevent undue expansion into the earthen wall.

Additional features of this invention are:

1. that it can be easily adapted to a hole having any desired diameter (merely by using larger radius bearing plates and/or additional or longer segments as the means for connecting each bearing plate to its respective wedge.);
2. that it provides a positive indication of the available earth holding strength (the travel distance of the eye or platform for engaging the external force can be translated into a travel distance for the expanding cylindrical bearing segments which indicates actual soil strength.); and
3. that it eliminates installing counterpoise or ground rods since its total steel construction gives sufficient ground contact for assured electrical grounding of the supported structure.

In a preferred form of my invention I provide a head containing a chamber in which an explosive charge is engageable. The charge is detonated by any standard electrical method or standard impact method and the resulting explosion drives a piston out of the chamber which in turn forces away from the chamber a rod which is connected to the piston by threading, welding, etc. and which has a tapered conical or pyramidal portion. Segmental wedges conforming to the tapered surface remain substantially vertically stationary but slide on the tapered portion of the rod and are forced expandably outward. Each of the above wedges is connected to a bearing plate by a series of interlocking bolts (interlocking plates can also be used) extending through a guide frame. The bearing plates can be banded when necessary to maintain a substantially closed position during placement of the apparatus into an earthen hole. Upon detonation each of the outwardly sliding wedges forces its respective bearing plate against the walls of a preformed earthen hole. The external force, either compressive in the form of the weight of a street light standard or house trailer body, or tensile in the form of guy lines, is then engaged with the rod at its uppermost end by means of a platform or an eye. If movement urged by compressive forces is to be resisted, the piston and rod must be driven downwardly in a direction into the earthen hole in order that the compressive force serves to further lock the apparatus in place. If movement urged by tensile forces is to be resisted, the piston and rod must be driven upwardly in a direction out of the hole in order that the tensile force serves to further lock the apparatus in place. Guide plates inserted in the guide frame can be used to prevent other than axial movement by the rod. Depending on the relationship between the strength of earth at the particular situs and the support strength requirement, the force of the explosive charge can be increased, the number of wedge-to-bearing plate connections can be increased, and the size of the bearing plates can be increased to give a greater total load bearing surface.

In the foregoing general description of my invention, I have set out certain purposes, objects and advantages of my invention. Other objects, purposes and advantages of the invention will be apparant from a consideration of the following description and accompanying drawings in which:

FIG. 3 is a cutaway perspective view of the apparatus as it would be constructed to restrain movement urged by a tensile force, showing substantially all its interconnecting component parts.

FIG. 4 is a cross-sectional view through the centerline of the earthen hole and apparatus as it would be constructed to restrain movement urged by a compressive force, the apparatus being in a pre-detonated, unexpanded position.

FIG. 5 is a cross-sectional view on line V—V of FIG. 3.

Figure 1:
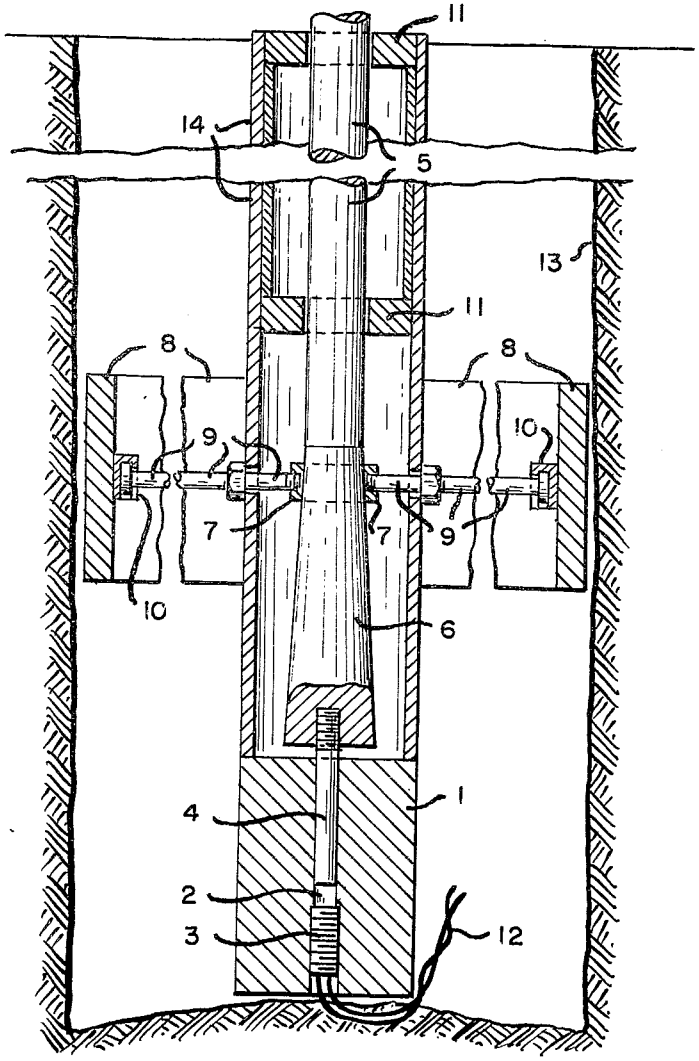
FIG. 1 is a cross-sectional view through the centerline of the earthen hole and apparatus as it would be constructed to restrain movement urged by a tensile force, the apparatus being in a pre-detonated, unexpanded position.

Referring to the drawings, I have illustrated in FIG. 1 the apparatus, as it would be constructed to restrain movement urged by a tensile force, in an unexpanded position. The head 1 contains a chamber 2 into which an explosive device 3 is inserted. This device may be detonated using lead wires 12 with any standard electrical detonator. The piston 4 is connected to a rod 5 with a tapered portion 6. Segmental wedges 7 are shown resting on the tapered portion 6 at a point of relatively small cross-sectional area and are connected to the cylindrically segmented bearing plates 8 by interconnecting bolts 9 through holes in a tubular guide frame 14. To complete the connection the head of each outermost bolt fits into an open ended slotted box 10 positioned radially outwardly from each outermost bolt and attached to the inside of a bearing plate. The guide plates 11 may be inserted to prevent other than axial movement of the rod 5.

Figure 2:
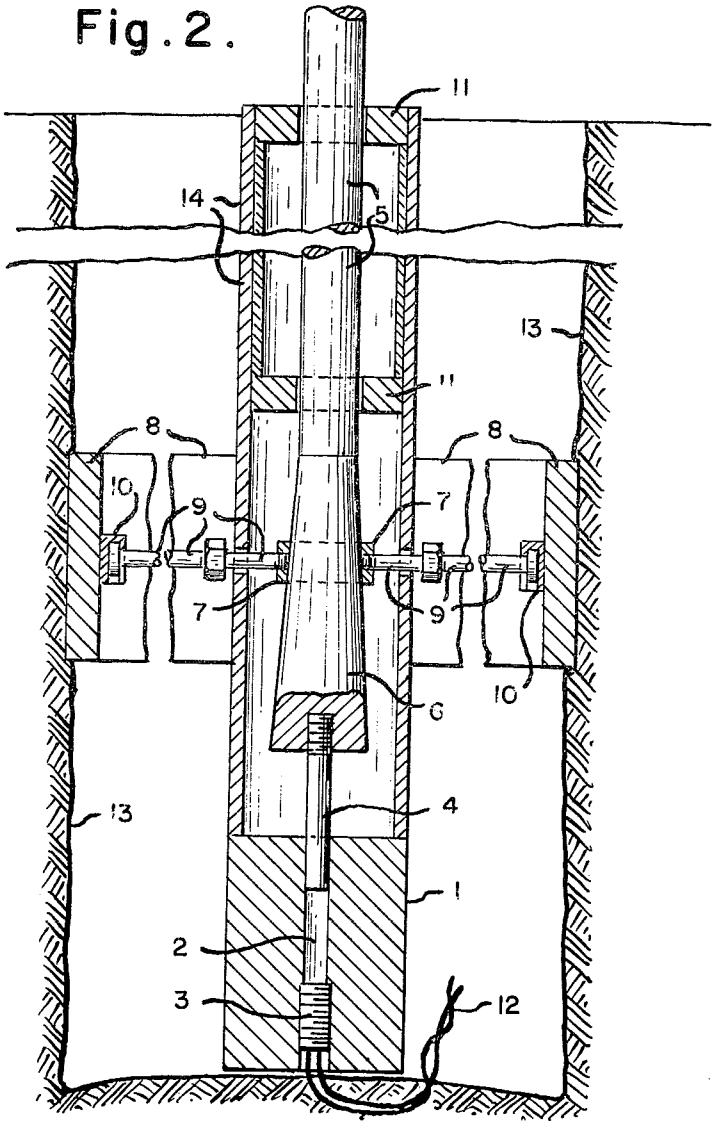
FIG. 2 is a cross-sectional view through the centerline of the earthen hole and apparatus as it would be constructed to restrain movement urged by a tensile force, the apparatus being in a post-detonated, expanded position.

FIG. 2 illustrates the apparatus as it would be constructed for restraining movement urged by a tensile force and is in an expanded position. The piston 4 and rod 5 in the position as shown have been forced upwardly by detonation of the explosive charge 3 and the segmental wedges 7 have been forced radially outwardly driving the bearing plates 8 against and into the earthen wall 13.

FIG. 3 is a cutaway perspective view of the apparatus as it would be constructed for restraining movement urged by a tensile force. The sliding wedges 7 are shown in position behind the cutaway of the tubular guide frame 14. Interconnecting bolts 9 are shown (here, four bolts per wedge per bearing plate) protruding through the tubular guide frame 14 and engaging the bearing plates 8 by means of an open ended slotted box 10. At the uppermost end of rod 5 opposite the end attached to the piston 4, is attached an eye 15 as a means for engaging the rod 5 with an external tensile force (e.g., that of a guy line).

FIG. 4 is a cross-sectional view of the apparatus as it would be constructed for restraining movement urged by a compressive or gravitational force. Like parts on this embodiment have the same number with a prime affixed thereto. It illustrates the platform 16 for engaging the external compressive force and illustrates the head 1', two chambers 2', two explosive charges 3', and two pistons 4' to balance the force applied to the rod 5' at detonation. After detonation, the rod would be driven downwardly and the tapered portion 6' would force the sliding wedges 7' outwardly thus driving the bearing plates against and into the earthen wall 13. Guide plate 11' is used to help prevent other than axial movement of the rod 5'.

FIG. 5 is a cross-sectional view on line V—V of FIG. 3 illustrating the relative radial positioning of the rod 5, the slidable wedges 7, the interconnecting bolts 9, the tubular guide frame 14, and the bearing plates 8.

In the foregoing specification, I have set out certain preferred embodiments of my invention, however, it will be understood that this invention may otherwise be embodied within the scope of the following claims.

I claim:

1. An apparatus for expandably engaging the walls of an earthen hole in order to resist movement urged by an external force, comprising:

a. a head containing a chamber;

b. an explosive charge insertable into the chamber of said head and engageable therein;

c. means for detonating said explosive charge;

d. a guide frame attached to said head;

e. a piston slidably disposed within at least a part of the chamber of said head;

f. a rod connected to said piston, a portion of said rod being tapered in shape the largest cross-sectional area of which is located nearest the part of said rod connected to said piston;

g. means for connecting said piston to said rod;

h. means for engaging said rod with the external force;

i. a plurality of radially movable tapered segmental wedges slidably engageable with the tapered portion of said rod;

j. a plurality of cylindrical segmental bearing plates spaced from the wedges and adapted to be moved from a first closed position in which they form a substantially cylindrical wall to a second radially extended position in which they are circumferentially spaced apart; and k. means for operably connecting each of said bearing plates to said segmental wedges, slidably through said guide frame, whereby when said charge is detonated the rod and piston act on the wedges to radially move the bearing plates to engage the earthen hole wall.

2. An apparatus as described in claim 1 for expandably engaging the walls of an earthen hole in order to resist movement urged by an external tensile force, wherein:

said means for engaging said rod with the action external force is an hook means attached to said rod opposite the extreme end connected to said piston.

3. An apparatus as described in claim 2, wherein:

a. each cylindrical bearing plate has a box member adapted to engage a machine bolt head on its concave side; and b. said means for operably connecting each of said bearing plates to said segmental wedges being a plurality of bolts, the innermost being rotatably insertably connectable to one of said segmental wedges and disposed slidably through said guide frame, and the outermost being rotatably insertably connectable to the head of the innermost bolt and having a head insertable into said box member of said cylindrical segment bearing plate.

4. An apparatus as described in claim 3, wherein:

a. said guide frame is tubular.

5. The apparatus of claim 1, wherein said cylindrical segmental bearing plates are equal in number to the number of said tapered segmental wedges.

6. The apparatus of claim 1 for expandably engaging the walls of an earthen hole in order to resist movement urged by an external compressive force.

7. An apparatus as described in claim 6, wherein:

a. each cylindrical bearing plate has box member adapted to engage a machine bolt head on its concave side; and b. said means for operably connecting each of said bearing plates to the respectively circumferentially positioned one of said segmental wedges being a plurality of bolts, the innermost being rotatably insertably connectable to one of said segmental wedges and disposed slidably through said guide frame, and the outermost being rotatably insertably connectable to the head of the innermost bolt and having a head insertable into said box member of said cylindrical segment bearing plate.

8. An apparatus as described in claim 7, wherein:

a. said guide frame is tubular.

9. The apparatus of claim 6, wherein said cylindrical segmental bearing plates are equal in number to the number of said tapered segmental wedges.

10. The apparatus of claim 9, wherein said means for engaging said rod with the external force is a plate attached to said rod at one end.

11. An apparatus as described of claim 10, wherein two pistons are connected to said rod.

* * * * *